US010209021B1

(12) United States Patent
Huang

(10) Patent No.: US 10,209,021 B1
(45) Date of Patent: Feb. 19, 2019

(54) INTERLOCKING, POSITIONING AND FIRING DEVICE FOR TOY GUN

(71) Applicant: KIEN WELL TOY INDUSTRIAL CO., LTD., New Taipei (TW)

(72) Inventor: Shun-Chi Huang, New Taipei (TW)

(73) Assignee: KIEN WELL TOY INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 15/814,408

(22) Filed: Nov. 16, 2017

(51) Int. Cl.
*F41B 11/89* (2013.01)
*F41A 19/10* (2006.01)
*F41A 19/53* (2006.01)

(52) U.S. Cl.
CPC ..... *F41A 19/10* (2013.01); *F41B 11/89* (2013.01); *F41A 19/53* (2013.01)

(58) Field of Classification Search
CPC .... F41C 3/14; F41C 3/16; F41C 9/085; F41A 19/53; F41B 11/89
USPC ..... 42/60, 62, 63, 67
See application file for complete search history.

(56) References Cited

U.S. PATENT DOCUMENTS 2,865,126 A * 12/1958 Dardick ..... F41A 9/27 102/436
5,160,795 A * 11/1992 Milliman ..... F41A 19/53 124/48
7,159,584 B2 * 1/2007 Maeda ..... F41A 9/73 124/41.1

* cited by examiner

*Primary Examiner* — Stephen Johnson
(74) *Attorney, Agent, or Firm* — Leong C. Lei

(57) ABSTRACT

An interlocking, positioning and firing device for a toy gun includes a trigger element, top portion formed on the trigger element, at least one toggle assembly configured on one side of the trigger element and bullet room element configured on one side of the toggle assembly, bullet placement spaces formed on the bullet room element, at least one interlocking element configured on one side of the trigger element and operated in cooperation therewith and hitting assembly configured on one side of the interlocking element and operated in cooperation therewith to hit bullets. Whereby, the bullets can be mounted inside the bullet placement spaces, and the toggle assembly can be forced to toggle the bullet room element by propping the top portion against the toggle assembly and the hitting element cannot be acted until the bullet is positioned correspondingly to the hitting element when the trigger element is pulled.

7 Claims, 5 Drawing Sheets

INTERLOCKING, POSITIONING AND FIRING DEVICE FOR TOY GUN

TECHNICAL FIELD OF THE INVENTION

The present invention relates to an interlocking, positioning and firing device for a toy gun, and more particularly to an interlocking, positioning and firing device for a toy gun, allowing a hitting element to be not acted until a bullet is positioned correspondingly to the hitting element so as to enable the bullet to be fired accurately.

DESCRIPTION OF THE PRIOR ART

Toy guns are the toys or quality goods collected by may adults or youngsters, and the kinds thereof are many, but the operational mechanism interlocking relationships thereof are different from one another. For example, Taiwan Patent No. M509337, titled "trigger interlocking mechanism for toy gun", mainly includes a trigger, push block, linking member, first pivoting portion, second pivoting portion, pulling member, claw portion, first return spring and second return spring. When the trigger is pulled, the second return spring will push the claw portion to be in engagement with an engagement portion, namely, the claw portion being pulled will be in engagement with one engagement block of the engagement portion, and a magazine mechanism will then be moved to rotate relatively to a gun body to a predetermined position to allow a bullet to be fired smoothly, thereby avoiding the bullet to be stayed between a gun bore and gun barrel. In addition, the first return spring will push the linking element to move downward when the trigger is released so as to relieve the engagement of the claw portion with the engagement block, allowing the linking element and the pulling element to be returned to a predetermined position so as to make the toy gun have a good firing speed and handle feel.

Although the technology mentioned above has a good firing speed and handle feel, the entire parts thereof are too many, causing the manufacturing process thereof to be very complicated, and further resulting in a long production time. In consequence, the production cost is increased and the competitiveness thereof is decreased.

SUMMARY OF THE INVENTION

To overcome the drawbacks mentioned above, the present invention is proposed.

The main object of the present invention is to provide an interlocking, positioning and firing device for a toy gun, using a trigger element, top portion, toggle assembly and bullet room element to enable the toggle assembly to toggle the bullet room element by propping the top portion against the toggle assembly when the trigger element is pulled.

Another object of the present invention is to provide an interlocking, positioning and firing device for a toy gun, using the trigger element, an interlocking and a hitting assembly to enable the hitting element to be not acted until a bullet is positioned to a position corresponding to the hitting element by moving the interlocking element with the hitting assembly when the trigger element is pulled.

To achieve the objects mentioned above, the present invention proposes an interlocking, positioning and firing device for a toy gun, including: a trigger element; at least one top portion, formed on the trigger element; at least one toggle assembly, configured on one side of the trigger element; at least one bullet room element, configured on one side of the toggle assembly, the toggle assembly forced to toggle the bullet room element by propping the top portion against the toggle assembly when the trigger element is pulled; a plurality of bullet placement spaces configured on the bullet room element, and adapted to accommodate bullets; at least one interlocking element, configured on one side of the trigger element and operated in coordination therewith; and at least one hitting assembly, configured on one side of the interlocking element and operated in coordination therewith to hit the bullet, the hitting assembly moved with the interlocking element when the trigger element is pulled. Whereby, the bullets can be mounted inside the bullet placement spaces, and the toggle assembly can be forced to toggle the bullet room element by propping the top portion against the toggle assembly and the hitting element cannot be acted until the bullet is positioned correspondingly to the hitting element when the trigger element is pulled, thereby achieving the accurate firing of the bullets.

DETAILED DESCRIPTION OF THE PREFERRED EMBODIMENTS

Figure 1:
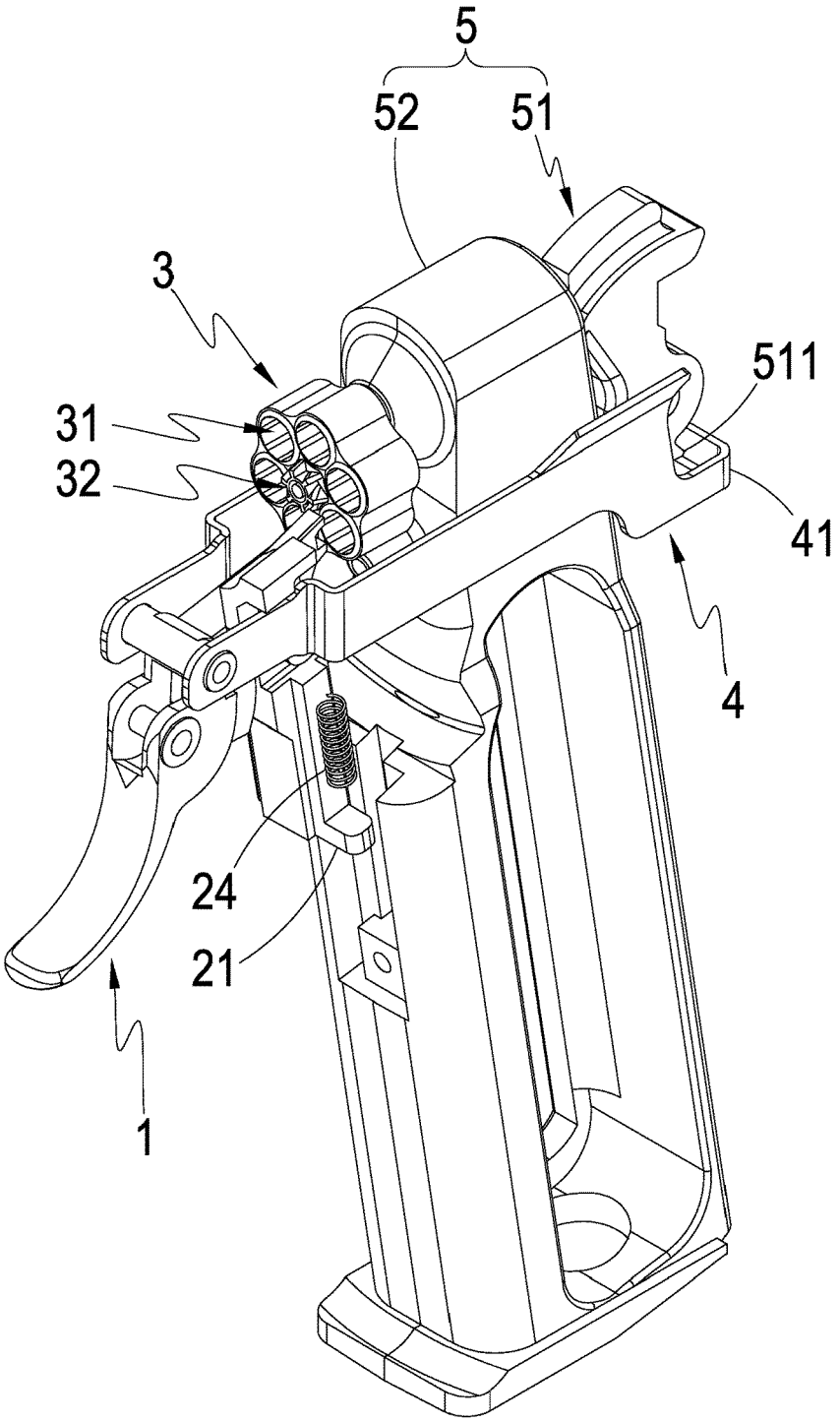
FIG. 1 is a perspective view of a preferred embodiment of the present invention.
Figure 2:
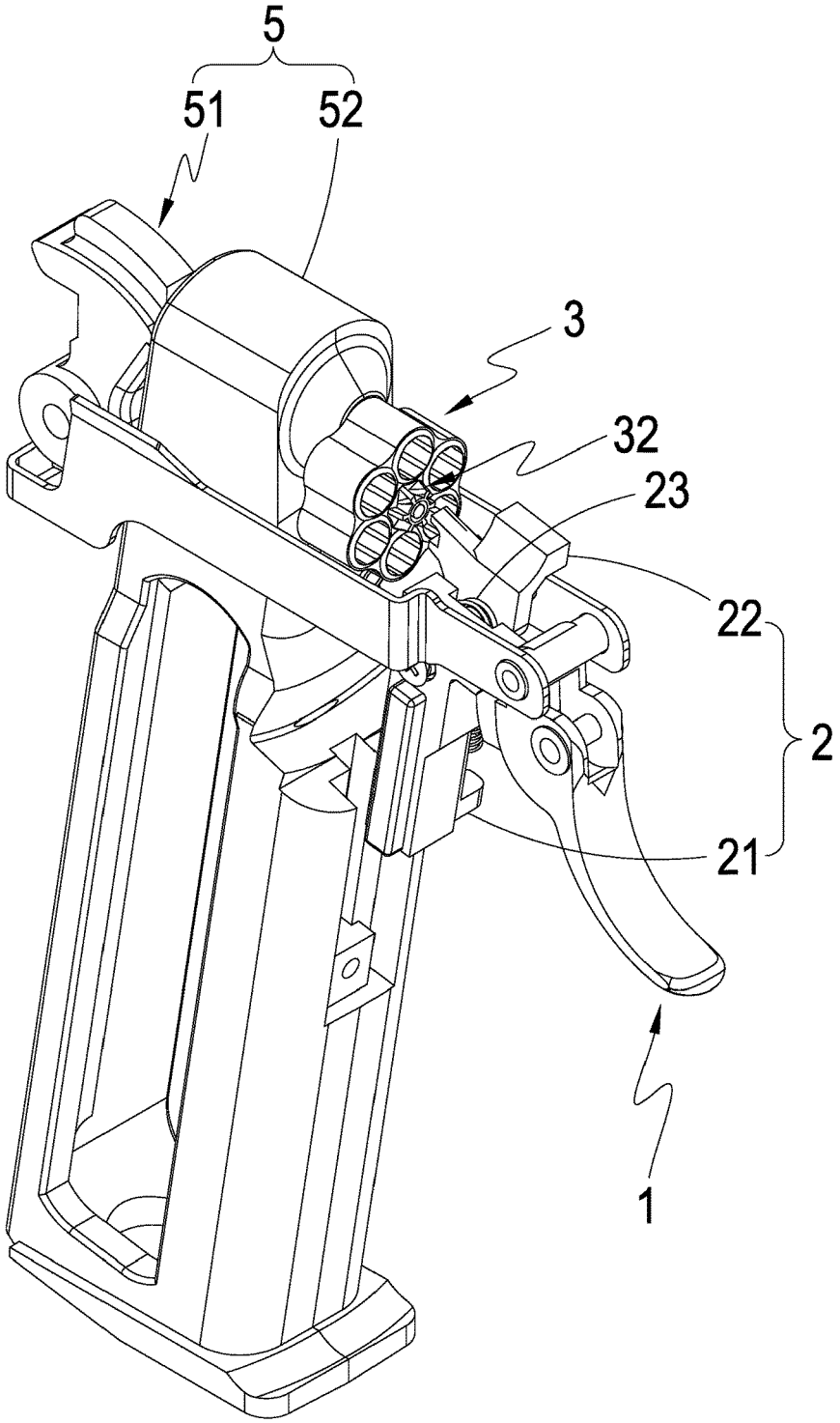
FIG. 2 is a perspective view of the embodiment of the present invention when viewed from another angle.
Figure 3:
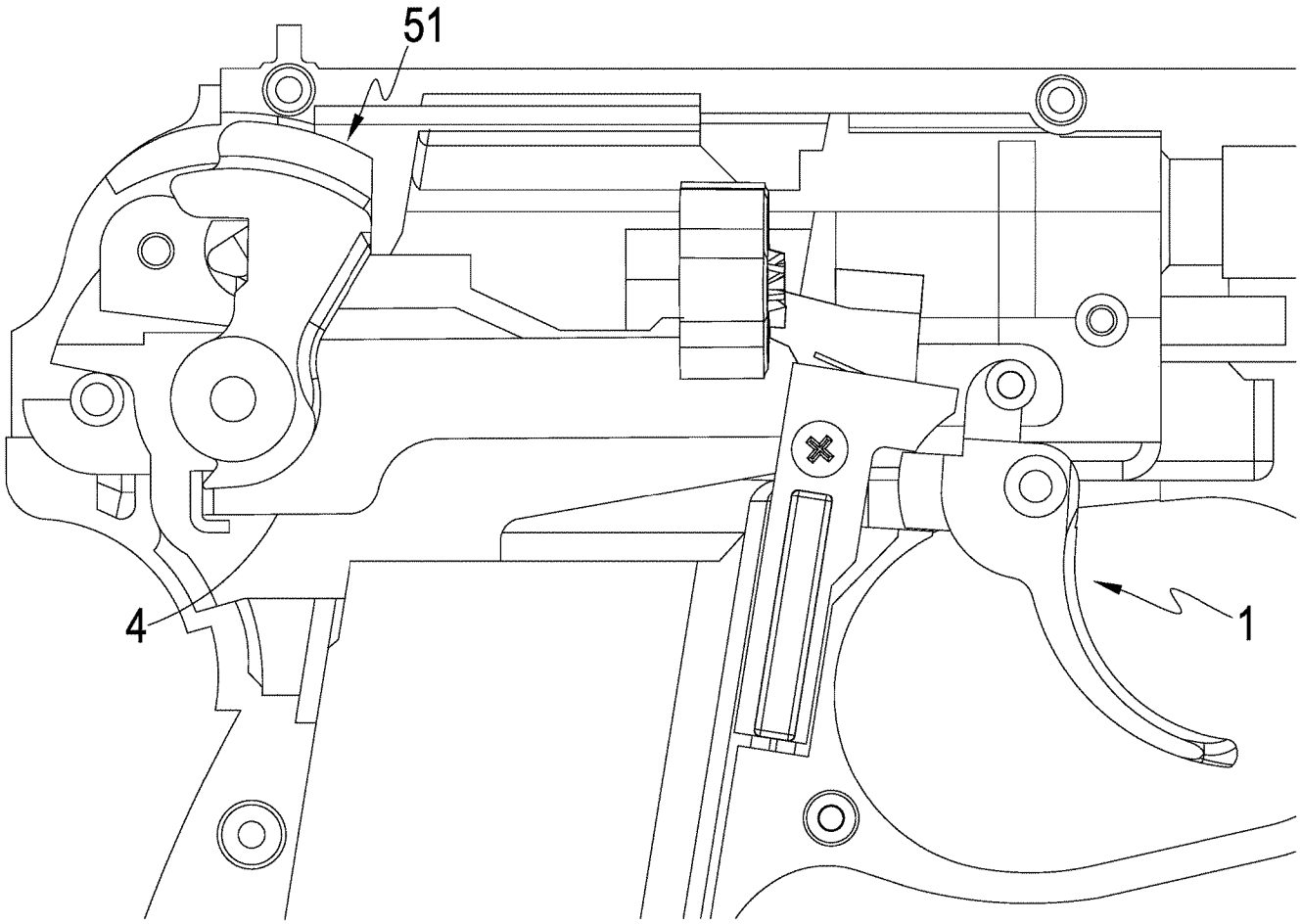
FIGS. 3, 4 and 5 respectively are a schematic view of the embodiment of the present invention in an action state.
Figure 4:
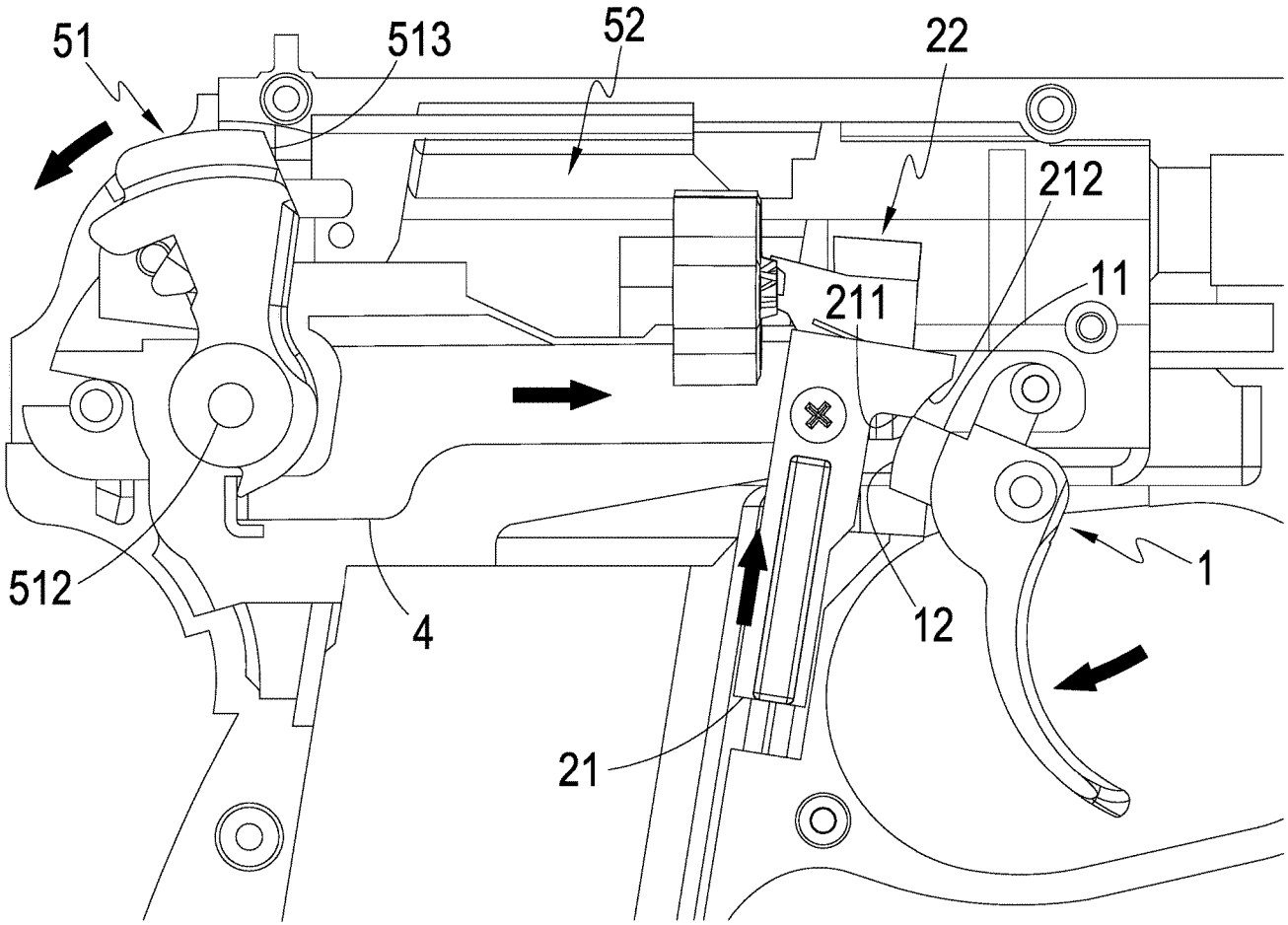
Figure 5:
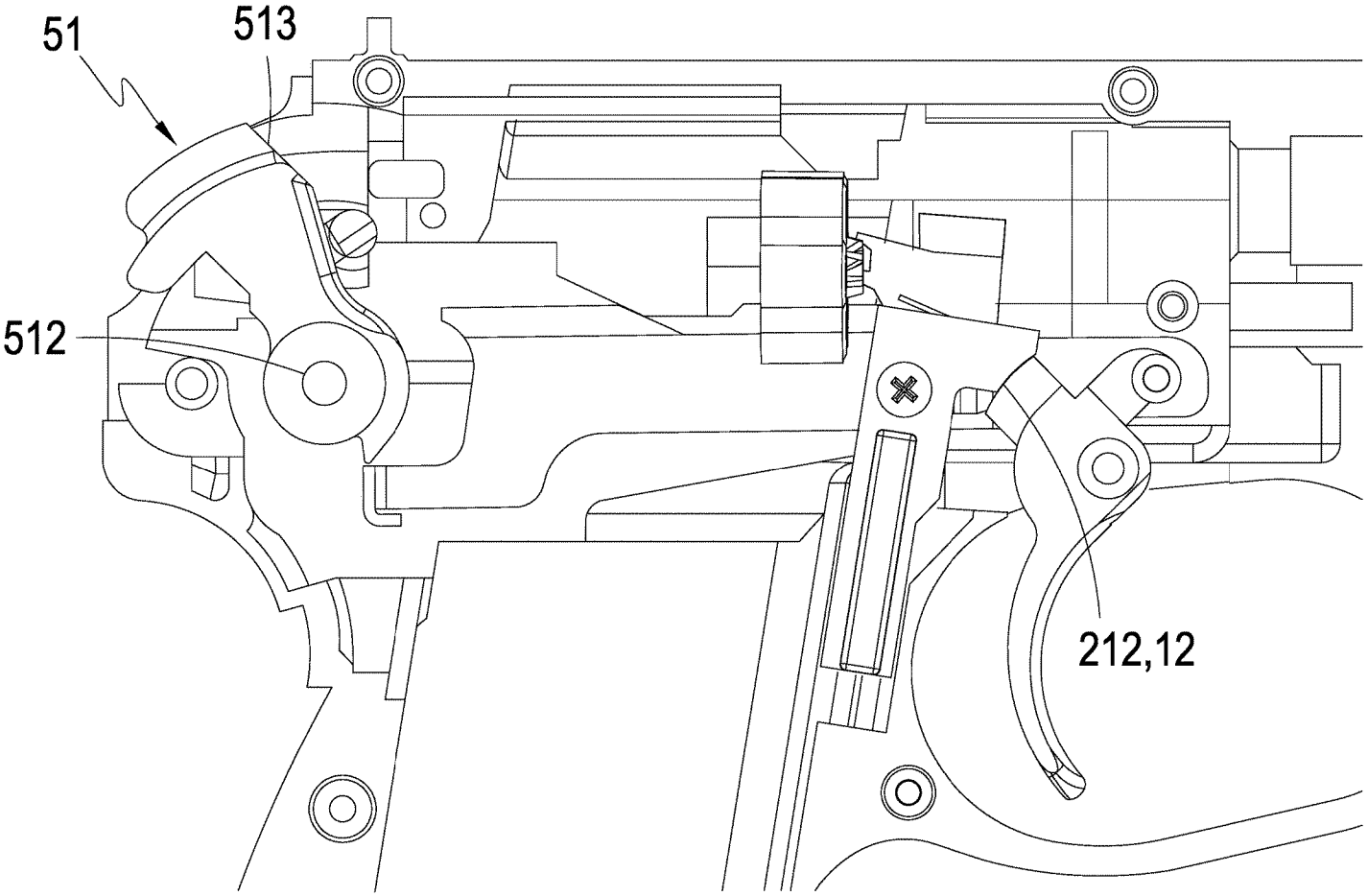

Referring to FIGS. 1 to 3, an interlocking, positioning and firing device for a toy gun of the present invention, in a preferred embodiment, includes: a trigger element 1, configured with at least one top portion 11; at least one toggle assembly 2, configured on one side of the trigger element 1, including at least one toggle seat 21 pushed by the trigger element 1 to move linearly and at least one toggle element 22 coupled pivotally to the toggle seat 21, at least one holding portion 211 adapted to hold the top portion 11 formed on the toggle seat 21, at least one first contact face 212 formed on one side of the holding portion 211, at least one second face 12 formed on one side of the top portion 11, at least one first elastic element 23 configured between the toggle seat 21 and toggle element 22, and at least one second elastic element 24 adapted to return the toggle seat 21 being configured on the toggle seat 21; at least one bullet room element 3, configured on one side of the toggle assembly 2, formed with a plurality of bullet placement spaces 31 for the mounting of bullets, and configured with a plurality of protrusions 32; at least one interlocking element 4, configured on one side of the trigger element 1 and operated in coordination therewith, and configured with at least one pull portion 41; and at least one hitting assembly 5, configured on one side of the interlocking element 4 and operated in coordination therewith to hit the bullet, and including a hitting element 51, and a valve element 52 configured at one side of the hitting element 51 and adapted to hit the bullet, at least one hook 511 holding the pull portion 41 being configured on the hitting element 51, at least one shaft 512 configured on the hitting element 51, and at least one hitting portion 513 adapted to hit the valve element 52 being formed on the hitting element 51.

Referring to FIGS. 1 to 5, a user, as the figures show, may place bullets inside the bullet placement spaces 31 of the bullet room element 3. When the user wants to fire the bullet, they may pull the trigger element 1 to cause the top portion 11 to be propped against the holding portion 211, thereby allowing the toggle assembly 2 to be pushed upward. Because the toggle assembly 2 includes the toggle seat 21 and toggle element 22, and the toggle element 22 is coupled pivotally to the toggle seat 21, the toggle element 22 is forced to prop against the protrusions 32 configured on the bullet room element 3 through the first elastic element 23, and the bullet room element 3 is then forced to rotate by toggling the protrusions 32 with the toggle element 22 to allow the bullet inside the bullet placement space 31 to be moved to a position corresponding to the valve element 52, and the pull portion 41 of the interlocking element 4 to be propped against the hook 511 to allow the hitting element 51 to be rotated around the shaft 512 through the interlocking element 4 to move the hitting portion 513 away from the valve element 52 when the trigger element 1 is pulled, where the hitting assembly 5 is used to fire the bullet, and the gas is used to fire the bullet after the hitting portion 513 of the hitting element 51 hits the valve element 52 to open the door of the valve element 52. Therefore, the toggle assembly 2 and hitting assembly 5 can be moved with trigger element 1 when the user pulls it, and the first contact 212 will be operated in coordination with the second contact face 12 to allow the hitting element 5 to be not acted until the bullet is positioned to a position corresponding to the hitting element 51 when the bullet is moved to the position corresponding to a position corresponding to the valve element 52. In addition, the hitting element 51 will not hit the valve element 52 to generate air to fire the bullet until the user releases the trigger element 1, and at the same time, the toggle seat 21 can be returned through the second elastic element 24, thereby achieving the accurate firing of the bullet.

From the description mentioned above, it can be understood clearly that the present invention has the following advantages over the prior arts:

1. the present invention can use minimal components to achieve the best operation process by means of the linear motion of the toggle seat 21, allowing the bullet room element 3 to be positioned precisely and the bullet to be fired accurately;
2. The top portion 11 is used to prop against the toggle assembly 2 to force it to toggle the bullet room element 3 when the trigger element 1 is pulled through the configurations of the trigger element 1, top portion 11, toggle assembly 2 and bullet room element 3; and
3. the hitting element 5 is moved with the interlocking element 4 to cause the hitting element 51 to be not acted until the bullet is positioned correspondingly to the hitting element 51 when the trigger element is pulled through the configurations of the trigger element 1, interlocking element 4 and hitting assembly 5.

I claim:

1. An interlocking, positioning and firing device for a toy gun, comprising:

a trigger element;

at least one top portion, formed on said trigger element;

a toggle assembly, configured on one side of said trigger element;

a bullet room element, configured on one side of said toggle assembly, said toggle assembly forced to toggle said bullet room element by propping said top portion against said toggle assembly when said trigger element is pulled;

a plurality of bullet placement spaces configured on said bullet room element, and adapted to accommodate bullets;

an interlocking element, configured on one side of said trigger element and operated in coordination therewith; and a hitting assembly, configured on one side of said interlocking element and operated in coordination therewith to hit said bullet, said hitting assembly moved with said interlocking element when said trigger element is pulled;

wherein said toggle assembly comprises at least one toggle seat pushed by said trigger element to move linearly;

wherein said toggle seat is formed with at least one holding portion adapted to hold said top portion; and wherein at least one first contact face is formed on one side of said holding portion and at least one second contact face on one side of said top portion such that said first contact face is set in operation in coordination with said second contact face to allow a hitting element of said hitting assembly to be not acted until one of the bullets is positioned to a position corresponding to said hitting element when the bullet is moved to a position corresponding to a valve element.

2. The device according to claim 1, wherein at least one first elastic element is configured between said toggle seat and toggle element.

3. The device according to claim 1, wherein said toggle seat is configured with at least one elastic element adapted to return said toggle seat.

4. The device according to claim 1, wherein said bullet room element is formed with a plurality of protrusions each toggled by said toggle element to cause said bullet room element to rotate.

5. The device according to claim 1, wherein said hitting assembly comprises said valve element configured at one side of said hitting element and adapted to hit said bullet.

6. The device according to claim 5, wherein said interlocking element is formed with at least one pull portion, and said hitting element has at least one hook adapted to hold said pull portion.

7. The device according to claim 6, wherein said hitting element is formed with at least one shaft, and said hitting element has at least one hitting portion adapted to hit said valve element.

* * * * *